US006085361A

United States Patent [19]

Whitaker

[11] Patent Number: 6,085,361

[45] Date of Patent: Jul. 11, 2000

[54] SANITARY TOILET BASE BAND

[76] Inventor: Jacquelyn M. Whitaker, 5008 N. 57th St., Omaha, Nebr. 68104

[21] Appl. No.: 08/517,202

[22] Filed: Aug. 22, 1995

[51] Int. Cl.[7] ..... E03D 11/00

[52] U.S. Cl. ..... 4/251.1

[58] Field of Search ..... 4/251.1, 251.2

[56] References Cited

U.S. PATENT DOCUMENTS

| | | | |
|---|---|---|---|
| 0,918,396 | 4/1909 | Tracy | 4/251.1 |
| 4,165,545 | 8/1979 | Stoltzfus | 4/251.1 |
| 4,348,776 | 9/1982 | Sarjeant | 4/300.3 |
| 4,722,103 | 2/1988 | Kliebert | 4/658 |
| 4,912,784 | 4/1990 | Jacobson | 4/300.3 |
| 4,975,990 | 12/1990 | Chan | 4/243 |
| 5,216,760 | 6/1993 | Brown | 4/300.3 |

*Primary Examiner*—Charles E. Phillips
*Attorney, Agent, or Firm*—David L. Baker

[57] ABSTRACT

The invention is a ring of rubber or plastic material that fits snug around the base of a toilet at its junction with the floor. The ring contains a channel with a sloping internal wall that engages the wall of the toilet base and causes liquids to collect in channel. A recess in the outside wall of the channel allows the liquid to escape into an appropriate container. The outside wall of the channel facing the front of the toilet bowl is raise to avoid over splash.

1 Claim, 1 Drawing Sheet

SANITARY TOILET BASE BAND

BACKGROUND OF THE INVENTION

1. Field of the Invention

This invention relates generally to plumbing accessories and in particular to a band of supple rubber or plastic that is designed to collect waste liquids at the base of a toilet bowl structure.

2. Description of the Problem and the Relevant Prior Art

A common and annoying problem for housekeepers and custodial personnel is the constant need to clean the outside of the toilet bowl of liquid that was inadvertently and sometimes carelessly allowed to splash outside of the bowl. In addition to the unsightliness, urine gives off a distinct and unpleasant odor which will reflect poorly on the home owner or cleaning organization in an unfair manner. In addition, where the liquids are allowed to remain on wooden floors the soil eventually becomes impossible to clean and replacing the floor is the only solution. On tile floors the stains will eventually etch the glaze and unable to be cleaned, will require replacement.

There are a number of devices that have been suggested to control the splash which contributes to the problem, however the prior art is void of any device that will collect, contain and control the spillage that results from liquids that find their way to the outside of a toilet bowl.

The following U.S. Patents are examples of splash guards found in the prior art: U.S. Pat. No. 4,348,776 issued Sep. 14, 1982 to Sergeant for a collapsible splash shield for a toilet; U.S. Pat. No. 4,722,103 issued Feb. 2, 1988 to Kliebert for a splash guard that could be used with a lavatory basin; U.S. Pat. No. 4,912,784 issued Apr. 3, 1990 to Jacobson et al. who show another form of toilet bowl splash guard; U.S. Pat. No. 4,975,990 issued to Chan for a disposable, splash-suppressing toilet seat cover with folded annular and bridging inner portions, and U.S. Pat. No. 5,216,760 issued Jun. 8, 1993 to Brown et al. who disclose a splash and overspray guard that may be adhesively attached to a toilet seat and expanded when the seat is raised.

SUMMARY OF THE INVENTION

The invention is characterized by a continuous ring of rubber or plastic that utilizes long memory elastic materials that will follow the junction of the toilet bowl base and the floor. The ring contains an upward facing channel that is juxtaposed to the base and includes a sloping wall that will tend to capture liquids moving down the outside of the bowl toward the base. The region of the ring in proximity of the front of the bowl contains a distal channel wall that is greater in elevation above the floor than the remainder of the ring although the channel is designed to have follow the contour of the floor which is usually level. In the proximity of the bolt securing the toilet to the soil pipe flange is a recessed area in the distal wall of the channel which allows the liquid to leave the channel where it is collected by some appropriate means not part of this invention.

The base band is easily removable for cleaning and/or replacement.

The invention will collect, store and release all moisture and liquids that originate at an elevation, higher on the toilet bowl, than the sloping internal wall of the channel.

It is therefore an object of the invention to provide a new and improved sanitary toilet base band.

It is another object of the invention to provide a new and improved sanitary toilet base band that will prevent moisture and liquids draining down the outside walls of the toilet bowl from reaching the floor.

It is a further object of the invention to provide a new and improved sanitary toilet base band that is easily cleaned.

It is still another object of the invention to provide a new and improved sanitary toilet base band that has all of the advantages of prior art toilet splash guards and none of the disadvantages.

It is still a further object of the invention to provide a new and improved sanitary toilet base band which is of a durable and reliable construction.

It is another object of the invention to provide a new and improved sanitary toilet base band which may be easily and efficiently manufactured and marketed.

It is another object of the invention to provide a new and improved sanitary toilet base band which may be added as part of the manufacturing process.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DETAILED DESCRIPTION OF A PREFERRED EMBODIMENT

Figure 1:
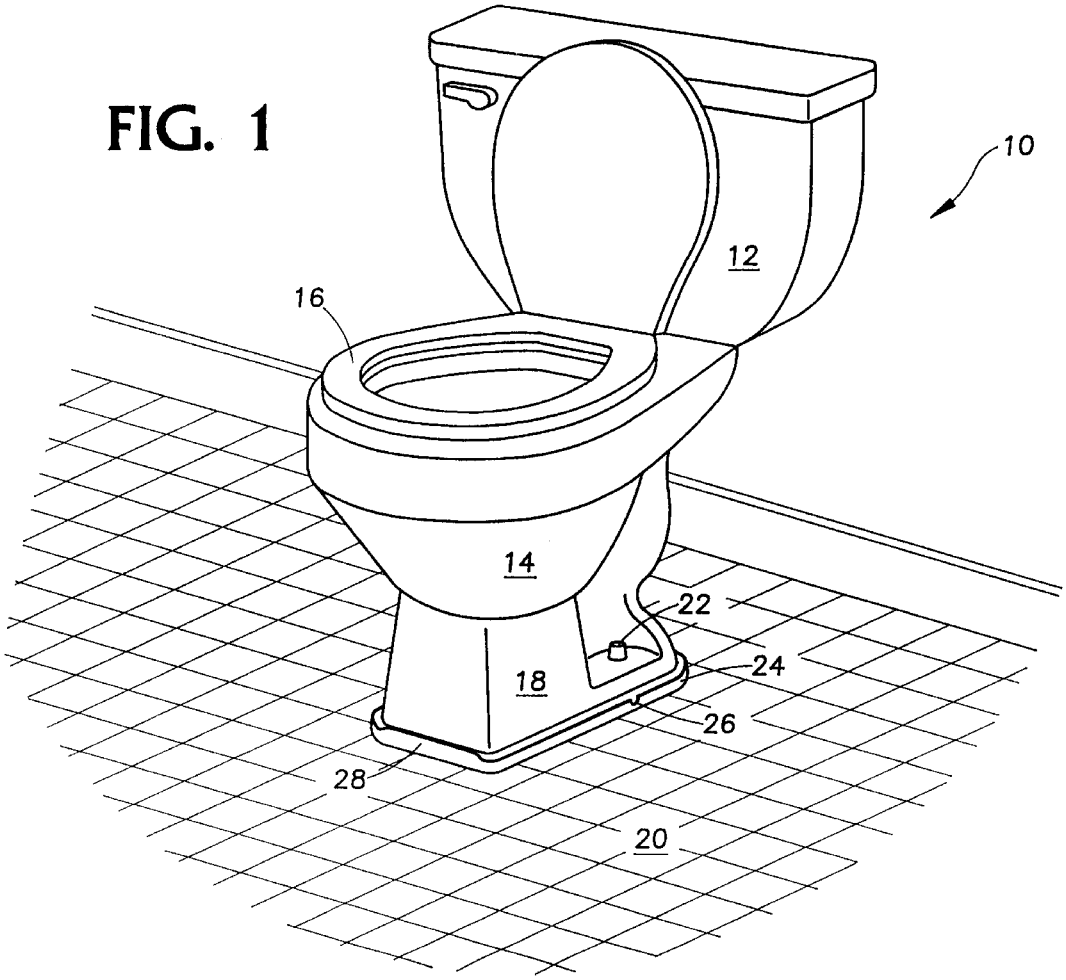
FIG. 1 is a environmental view of a conventional water closet.

Referring now to FIG. 1, a water closet or toilet is shown generally at 10 and consists of a tank 12, bowl 14, seat 16 and base 18. The base rests on a floor 20. The base is secured to the floor by a pair of bolts which engage the flange of the soil pipe which is not shown. The bolts are generally on opposite sides of the flange and are covered by caps such as the cap 22 for example. The invention is a contiguous ring 24 that is installed by slipping it over the water tank 12 and the bowl 14 to the base 18 where it rests on the floor 20. The ring is of a dimension that will cause it to fit in tight juxtaposition to the base when installed. The ring is formed of a rubber or polymeric material having sufficient elasticity to stretch and bend upon installation but with a long memory that will cause it to remain in a snug relationship with the base once installed.

In the region proximate one of the bolt covers 22, the distal wall of the channel formed in the ring 24 contains a recessed area 26 where the liquids collected are allowed to drain and be collected in an appropriate manner not the subject of this invention. The same distal wall is raised at 28, the area proximate the front wall of the bowl and base to prevent splash over.

Figure 2:
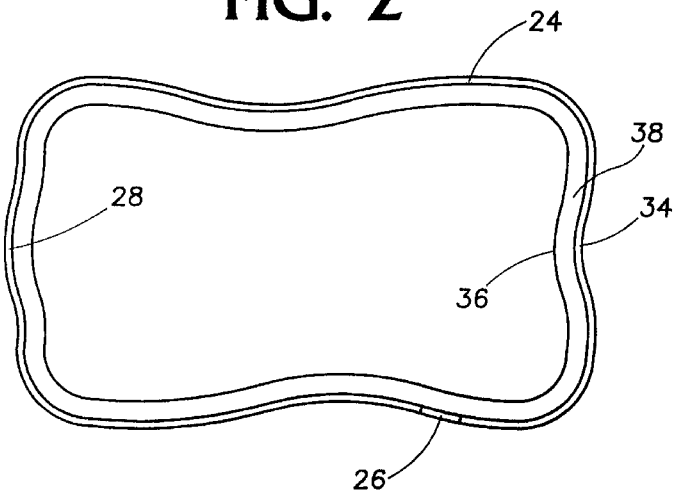
FIG. 2 is a top plan view of the base band of the invention.
Figure 3:
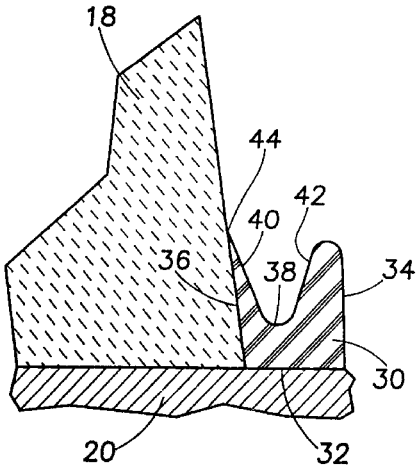
FIG. 3 is a cross sectional view of a section of the base and the base band.

Concerning FIGS. 2 and 3, the ring 24 has a generally rectangular shape and consists of a body 30 of rubber or polymeric material as described. One side of the body 32 is flat and adapted to rest on the floor 20. From this side are a pair of vertical walls including distal wall 34 and interior wall 36. Located between the walls is a channel 38 which collects the liquid from the base of the toilet 18. The internal wall 40 of the channel 38 slopes to the base 18 and forms an acute angle thereby creating, in effect, a sharp edge 44 at the juncture of the base and the wall which will cause the liquid to more easily roll into the channel. The opposed internal wall 42 is simply rounded and provides a pleasing effect.

It should be understood, of course, that the foregoing disclosure relates to only a preferred embodiment of the invention and that numerous modifications of alterations may be made therein without departing from the spirit and scope of the invention as set forth in the appended claims.

What is claimed is:

1. A sanitary toilet base band comprising:

a ring of elastic material having a first surface adapted to rest on a flat surface adjacent a toilet bowl;

said material being of such an elastic nature as to allow passage of said ring over a water closet tank and bowl;

a second and third surface extending from the first surface where the second surface is adapted to engage a base of a toilet;

the third surface includes a raised area;

a fourth surface opposed to the first surface and extending between the second and third surface and forming a channel;

the channel having a first internal wall sloping to and joining the second surface and a second internal wall joining the third surface; and a recess extending from the channel through the second internal wall to the third side, whereby liquids moving down the base of a toilet will be collected in the channel and released through the recess.

* * * * *